United States Patent [19]

Coe, Jr.

[11] Patent Number: 5,018,422

[45] Date of Patent: May 28, 1991

[54] PROCESS FOR IMPROVEMENT OF TONE IN VIOLINS AND RELATED INSTRUMENTS

[76] Inventor: Mayne R. Coe, Jr., 1211 Choctaw Street, Jupiter, Fla. 33458

[21] Appl. No.: 524,465

[22] Filed: May 17, 1990

[51] Int. Cl.[5] ..... G10D 1/02

[52] U.S. Cl. ..... 84/275; 144/380

[58] Field of Search ..... 84/274–275; 144/380

[56] References Cited

U.S. PATENT DOCUMENTS

| | | | |
|---|---|---|---|
| 856,533 | 6/1907 | Lawrence | 84/274 X |
| 1,083,510 | 1/1914 | Tietgen | 84/275 |
| 1,234,989 | 7/1917 | Wickstrom | 84/275 X |
| 1,622,484 | 3/1927 | Bamberger | 84/275 X |
| 1,700,395 | 1/1929 | Yukl | 84/274 |
| 1,836,089 | 12/1931 | Schweitzer | 84/274 |
| 2,516,467 | 7/1950 | Kenyon | 84/274 |
| 2,547,919 | 4/1951 | Dalmas | 84/275 X |
| 4,254,863 | 2/1981 | Song | 84/275 X |
| 4,822,690 | 4/1989 | Wahl | 428/498 |

OTHER PUBLICATIONS

Robert Teitelman, "A Strad By Any Other Name", Forbes, Jan. 30, 1984, pp. 114–118.

W. Henry Hill et al., *Antonio Stradivari His Life and Work,* Dover Publications, Inc., New York (1963), pp. 159–161.

Ed. Heron-Allen, *Violin-Making,* 2nd Ed., Ward, Lock & Co., Ltd., London (1885), pp. 168–175.

James Claude Thomson, *A Study of Chinese Wood Oils,* Ph.D. Dissertation, Columbia University, New York (1933), pp. 3–7.

Klare S. Marley, *Fatty Acids Their Chemistry and Physical Properties,* Inter Science Publishers, Inc., New York (1947), pp. 33–34, 42, 51 & 68.

International Institute of Agriculture, *The Tung Oil trees (Aleurites) and the Tung Oil Industry Throughout The World,* Villa Umberto I, Rome, Italy (1938), pp. 172–173.

Carleen M. Hutchins, "The Physics of Violins", The *Scientific American,* 207 (Nov. 1982), pp. 76–94.

William Jordon, *The Great Violin Mystery,* NOVA #813, WGBH Transcripts, Boston, Mass., (1981).

Robert S. McKinney, *Tung Oil,* U.S. Bureau of Agricultureal and Industrial Chemistry, AIC-94, USDA, Gainesville, Fla., Nov. (1946), 13p, Available at USDA Library.

*Primary Examiner*—Lawrence R. Franklin

*Attorney, Agent, or Firm*—Mason, Fenwick & Lawrence

[57] ABSTRACT

Violin bellies, backs, and sides are immersed in a varnish bath under conditions of elevated temperature and pressure for periods of time ranging from 1 to 14 days. The varnish bath contains a drying oil in a volatile solvent. In a preferred embodiment, the varnish bath contains 30–35% tung oil in a volatile solvent, such as turpentine or pertoleum ether. The temperature is preferably maintained between 70° and 95° F., and the pressure is preferably maintained between 1 and 10 psi above atmospheric pressure. In a preferred embodiment, the bellies are made of spruce and are immersed in the varnish bath for periods of time ranging from 1 to 14 days, while the backs and sides are made from maple and are immersed in the varnish bath for periods of time ranging from 1 to 3 days.

20 Claims, 1 Drawing Sheet

PROCESS FOR IMPROVEMENT OF TONE IN VIOLINS AND RELATED INSTRUMENTS

FIELD OF THE INVENTION

The present invention relates to string instruments with improved tone, and relates more particularly to violin type instruments made from wood that is chemically treated under elevated pressure and temperature for varying time periods.

BACKGROUND OF THE INVENTION

For over 250 years the secret to building violins with the power and tonal quality of those made by the pupils and descendants of Andrea Amati has been lost. Amati of Cremona, Italy, and in particular, his students Antonio Stradivari and Giuseppe Guarneri, produced instruments of such extraordinarily high quality that even today it is impossible to duplicate their work. Stradivari and Guarneri died with their violin making secrets, and great effort has been expended in attempting to find the secrets behind the exceptional tone and power of the Cremonese violins.

In order to discover the secrets behind the tone and power of great violins, it is first necessary to understand how violins are made, and how they produce sound. A violin is basically a set of strings mounted on a wooden box. Energy from vibrations that are induced by drawing a bow across the strings is transferred to the box and air space enclosed by the box. The vibrations of the wood in the violin set the air in the box in motion to produce sound waves. The tone and power of the instrument depend on the transfer of the vibrational energy of the strings to the box and to the surrounding air.

A more detailed understanding of violin acoustics is presented in "The Physics of Violins," *The Scientific American,* 207 (November 1982) pages 76–94, herein incorporated by reference. As noted above, when playing violin type instruments, vigorously drawing a bow across the strings causes them to vibrate. Since unamplified strings have insufficient surface area to set an appreciable amount of air in motion, the string vibrational energy is communicated through the wooden body of the violin through the complex motions of the violin bridge. Each of the strings vibrates at a particular frequency, and forces the box to vibrate at that particular rate. The amplitude of vibration in the box depends upon the strength or amplitude of the string vibration. However, different string tones are not amplified equally. The wooden structure itself has multiple natural vibration frequencies, some of which coincide with string harmonic frequencies. The coincidence of a string harmonic frequency with a resident frequency in the wood results in enhanced transfer of energy from the string to the box causing greater amplification of that particular tone.

Controlling the tone and amplitude in violin-type instruments is a challenging and difficult task. Numerous factors influence the tone and power of these instruments. For example, the choice of wood, the shape and thickness of the wood, and the varnish applied to the wood have all been characterized as critical factors in producing high quality violin-type instruments. The relative importance of material, dimensions and construction, and varnish are classified in *Antonio Stradivari, His Life and Work* (1644–1737) by W. Henry Hill, Arthur F. Hill, F.S.A., and Alfred E. Hill, published by Dover Publications, Inc., New York (1963), and herein incorporated by reference. Hill et. al. classified varnish as the most important element in producing a good violin, with construction and dimensions being the second most important element, and material being the third most important element.

Researchers have concentrated on duplicating the exact structure of the violins produced by Stradivari and the other great violin makers of Cremona. Some of these experiments were discussed in the Oct. 11, 1981 televised broadcast of Nova on PBS entitled *The Great Violin Mystery* Nova #813, available from WGBH Transcripts, Boston, Mass., and herein incorporated by reference. One researcher, Jack Fry, discovered that the thickness of the wooden backs of violins produced by the great Cremonese violin maker, Guarneri Del Gesu, were slightly asymmetrical, and later measurements of other great Italian instruments revealed similar asymmetry. The asymmetry appears to be intentional to adjust for the asymmetrical positioning of the sound post in the violins. Better quality violins are now made by duplicating this asymmetry, but these violins still lack the tonal quality achieved by the Cremonese violin makers.

Fry also attempted to experiment with different varnishes and methods of application. One experiment involved application of a solution of resins to the inside of a violin, and heating it to try to force the varnish into the wood. However, the effect this had on the stiffness of the wood and the resulting sound of the violin was not discussed.

Fry, among others, recognized that varnishes play a critical role in changing the ultimate stiffness and tone of violins, but the prior art could not control the impregnation of wood with varnishes to the same degree that the thickness of the wood could be graduated. Hence, while researchers have been able to duplicate many of the physical characteristics of the Cremonese violins, they have been unsuccessful in producing violins having the power and tone of a Stradivarius or a Guanerius. The missing ingredient appears to be the particular varnish used and method of application.

The prior art has recognized the importance of the types of material used and the exquisite detail necessary for construction of violins of the same quality as those produced by Stradivari and the other great violin makers of Cremona. The importance of varnish in modifying the tone of the violins has also been recognized, but there remains a need for an effective method of applying the varnish to the violin wood such that violin type instruments can be produced having improved tone and power.

OBJECTS OF THE INVENTION

Thus, it is a primary object of the present invention to produce violins and violin type instruments with improved tone.

It is a further object of this invention to provide a process for treating wood to be used in violins with varnish such that violins using the treated wood have improved tone.

It is yet another object of this invention to provide a process for producing violins of improved tone that does not substantially increase the cost or difficulty of conventional violin producing processes.

SUMMARY OF THE INvENTION

These and other objects of the invention are achieved in a preferred embodiment by immersing wood pieces to be used as the bellies, backs, and sides of violins in a varnish solution containing a drying oil under conditions of elevated temperature and pressure for varying periods of time. In a preferred embodiment, the backs and sides are formed from curly maple, and are immersed in a 30–35% solution of tung oil in petroleum distillate or other solvent for periods of time ranging from twenty-four to seventy-two hours. The bellies are preferably made from spruce wood and are immersed in the tung oil solution for periods of time ranging from one day to two weeks. In a preferred embodiment, the varnish temperature varies from 75 degrees Fahrenheit to 95 degrees Fahrenheit, and the pressure is held at approximately 5 psi above atmospheric pressure.

Preferably, nitrogen is pumped into the vessel containing the violin wood pieces and the varnish solution to maintain elevated pressure while preventing excessive oxidation of the drying oil in the varnish. The backs, bellies, and sides are hung up to dry for a week after removal from the varnish bath.

The oil varnish permeated wood pieces are then incorporated into violins or violin type instruments, and four to six coats of the same oil varnish are applied to the exterior of the violins, allowing one week drying intervals between application of varnish coats. The completely varnished violins are allowed to dry for about three (3) months or until tackiness disappears.

DETAILED DESCRIPTION OF THE INVENTION

Many modern violins are treated with sizing to prevent penetration of the wood by oil and alcohol soluble varnishes. In my process, no sizing is used, and the varnish is applied by immersing the violin wood pieces in varnish under conditions of elevated temperature and pressure for extended periods of time. The ability of the varnish to penetrate the wood depends on the type of the wood. Since there is more than one type of wood used to make the different violin elements, the description of my invention is facilitated by first providing a description of the basic elements of the violin which are to be treated.

Figure 1:
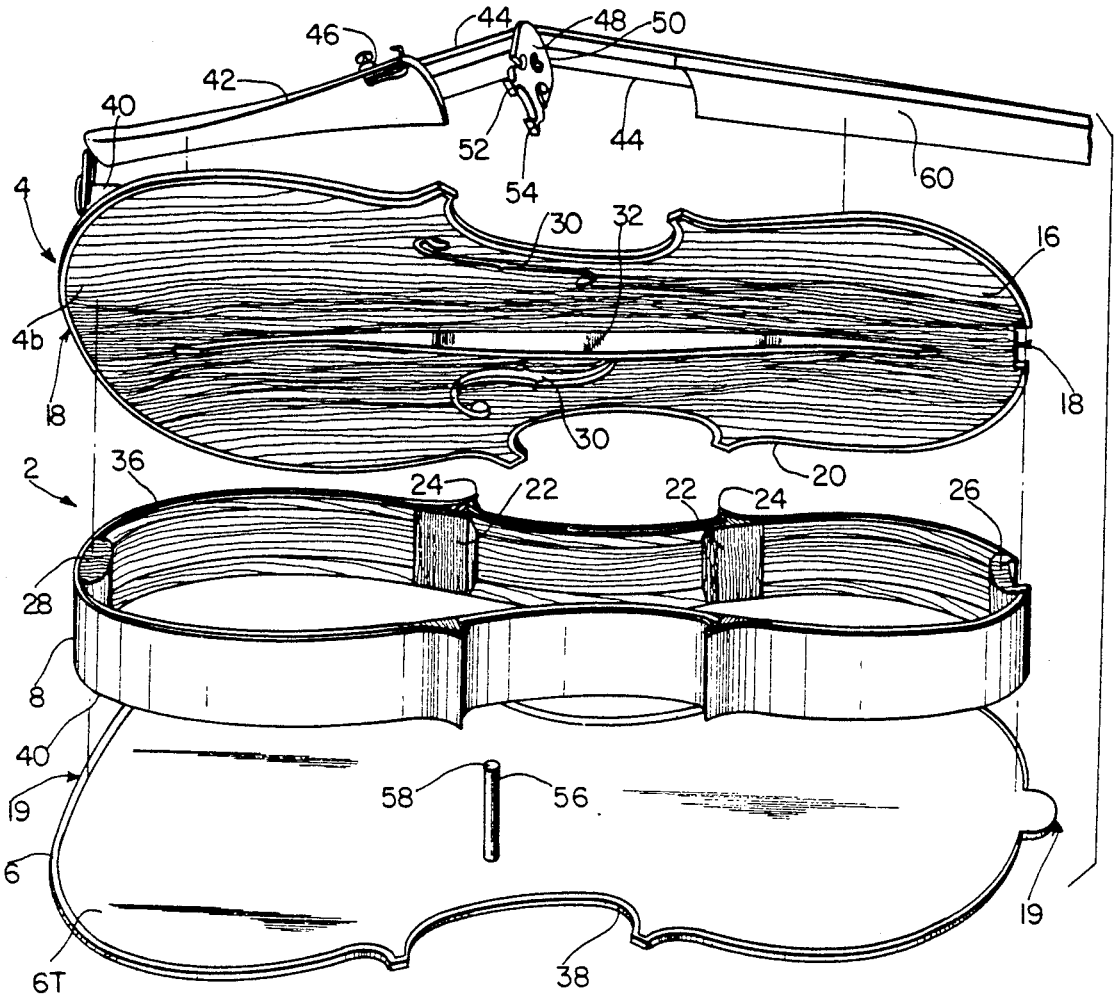
FIG. 1 is an exploded view of the box of a typical violin type instrument.

With reference to FIG. 1, an exploded view of the acoustic sounding box portion of a typical violin is illustrated. The box 2 consists of a front plate or belly 4 and a back plate or back 6. Belly 4 and back 6 are slightly arced outward to form broad bell-like or convex shapes. Back 6 and belly 4 are held in spaced parallel relationship in the violin by sides 8.

Figure 2:
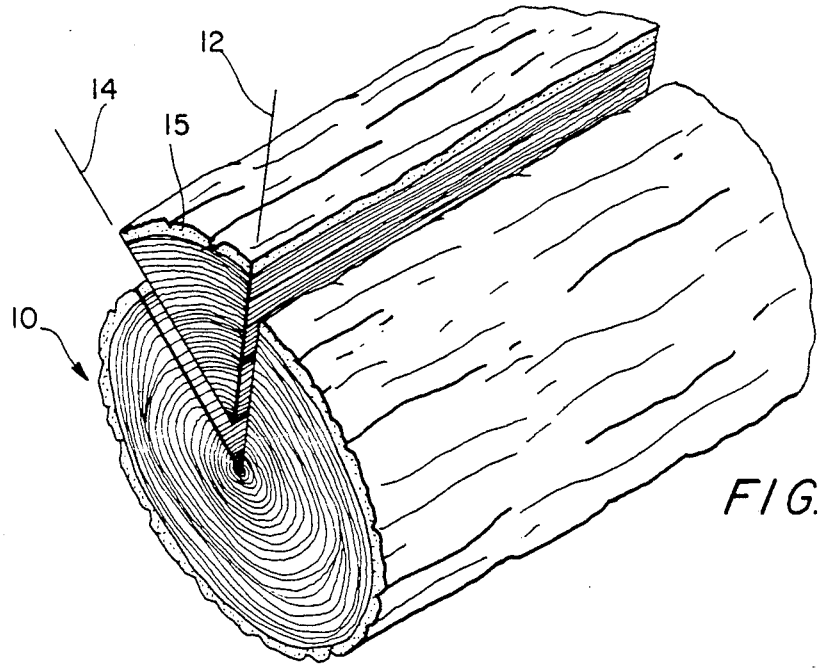
FIG. 2 is an exploded view of a tree cross-section with a piece of wood cut on the quarter from it.

Back 6 and sides 8 are preferably made from curly maple that is seasoned for at least ten years and not kiln-dried. Belly 4 is preferably made from spruce. The wood used for the belly, back, and sides is preferably wood that is cut on the quarter. With reference to FIG. 2, a cross-section of a tree 10 is illustrated. Intersecting lines 12 and 14 illustrate how the tree should be cut to produce wood piece 15 cut on the quarter (or otherwise known as wood cut the right way of the grain).

Referring back to FIG. 1, belly 4 is preferably made from two pieces that are mirror images of each other. The resulting belly 4 has grains 16 which become progressively finer as the center 18 of the belly is approached. This effect is achieved by gluing together two appropriately shaped pieces of spruce that are cut on the quarter so that the finer grain of one piece is adjacent to the finer grain of the other piece. The back 6 is preferably formed from two pieces of maple in a similar fashion to the belly 4.

Belly 4 and back 6 can be carved with a chisel, plain, or scraper, or by other mechanical means to have the desired shape and thickness. Back 6 preferably has a thickness that varies from about six millimeters in the center 19 to almost 2 millimeters inside the edges 38. Sides 8 are preferably made from the same wood as the back 6, and sides 8 have a uniform thickness of approximately one millimeter. Sides 8 are preferably formed by bending strips of curly maple into the shape of sides 8; blocks 22, made from spruce or willow, are then set in corners 24 and at the forward end 26 and rear end 28 to reinforce sides 8.

Belly 4 preferably has a uniform thickness which ranges from two to three millimeters, and has a pair of f-shaped holes 30 that are cut into plate 4 to allow for the exchange of air (and allow for sound to escape). A bass bar 32 is laterally attached to the bottom **4*b* of belly 4. Bass bar 32 is set off from the center 18 of belly 4** for a purpose to be described later.

Box 2 is constructed by joining together edge 20 on the bottom **4*b* of belly 4 with the top edge 36 of sides 8, and by joining edge 38 on the top 6*t* of back 6 with bottom edge 40 of sides 8. A hole (not shown) in end block 28 permits insertion of end button 40. End button 40 is connected to tail piece 42. Strings 44 are connected to fine tuner 46 on tail piece 42 and are supported above belly 4 by bridge 48. Bridge 48 has an arcuately shaped upper surface 50 upon which strings 44 press against, and has two feet 52 and 54 which stand perpendicularly astride of center 18 on the top surface (not shown) of belly 4. Foot 54 is aligned so that it applies pressure to the top side of belly 4 immediately above bass bar 32 attached to the bottom 4*b* of belly 4. A sound post 56 is situated asymmetrically in box 2 so that foot 52 applies pressure on the top surface of belly 4 and bottom 4*b* of belly 4 presses against the top 58 of sound post 56**.

Finger board 60 is attached to the top surface of belly 4 and to the neck (not shown) of the violin instrument. Vibrational energy of strings 44 is transmitted through bridge 50 to box 2, and induces vibrations in box 2. The resulting vibrations in box 2 vibrate enclosed air to produce sound waves which escape through f-holes 30. Note that small changes in the position, tightness, and wood quality of sound post 58 can also greatly alter the tone of the violin.

My invention focuses on a method for applying varnish to the bellies, backs and sides of violin-type instruments and the instruments which result therefrom. I have discovered that violins made with wood that was varnished with just a brush are not capable of producing the volume and tone of violins that are made from wood which has been immersed in varnish under elevated pressure and temperature for a period of time. This is due to the enhanced penetration of the wood by the oils of the varnish. The increased pressure and temperature increases the ability of the varnish to penetrate deeper into the wood than mere application with a brush allows, and, in some cases, the elevated temperature and pressure can enable penetration of the varnish completely through the wood.

Upon drying of the varnish, wood treated by immersion in varnish under elevated temperature and pressure will form violin type instruments having improved tone and power. Using the process of the present invention, violins and violin type instruments can be produced that, when played, have none of, or less of, the metallic shrillness that accompanies the playing of most modern violins. In fact, violins made with wood treated by my process produce a peculiarly penetrating tone, even powerful and brilliant.

In a preferred embodiment, the varnish should contain a dispersion of one or more conjugated polyolefinic glyceride drying oils. Drying oils absorb oxygen and become hard and resinous over time; hence, violins made with wood treated with varnish will have a tone which changes over time. Preferred drying oils include triolefinic glyceride oils such as tung oil and oiticica oil. Tung oil, or Chinese wood oil, is a rapidly drying oil from the nuts of *Aleurites cordata* and *Aleurites fordii* (Euphorbiaceae). Tung oil is indigenous to China and Japan, but is now grown in the United States (Florida) and elsewhere. Oiticica oil is a white fat from the nuts of the Brazilian oiticica tree *Licania rigida* (Rosaceae); it resembles tung oil and contains coupeic acid. Oils, such as lumbang oil, eleostearic acid, linoleic acid and linolenic acid, may also be used. Lumbang oil, or candle nut oil, is a colorless oil expressed from the seeds of *Aleurites moluccana.* Eleaostearic acid, eleaostearic acid, or eleastearic acid, is extracted from the seeds of *Elaeococca vernicia,* and has the following formula:

$$CH_3(CH_2)_3CH{=}CH{-}CH{=}CH{-}CH{=}CH{-}(CH_2)_7COOH.$$

Note that the double bonds at the 9, 11, and 13 positions are conjugated; this unsaturation contributes greatly to the usefulness of eleostearic acid and other conjugated triolefinic acids as varnishes.

In a preferred process of the present invention, a 30–35% solution of tung oil in petroleum distillate, turpentine, or both is prepared. This is the tung oil concentration of a commercially available drying oil varnish; varnish having greater or lesser concentrations of oil can be used. Backs and sides made from maple are preferably immersed into the tung oil varnish solution for periods of time ranging from 24 to 72 hours. Holding the backs down in the solution with their concave surfaces facing upward prevents entrapment of air. The bellies are treated in a similar fashion to the backs, except that, due to the difficulty the oil has in penetrating the spruce wood used for the preferred bellies, immersion times range from 1 day to approximately two weeks.

In a preferred embodiment, the varnish is held at a temperature varying between 70° F. and 95° F., and the pressure is preferably held at 5 psi above atmospheric pressure. At temperatures above 95° F. and pressures more than 5 psi above atmospheric pressure, care must be taken to avoid leaching and warping of the wood. Hence, it is preferred that temperatures above 100° F. and pressures greater than 10 psi above atmospheric pressure not be used. If the temperature is too low, e.g., below 50° F., the increased viscosity of the varnish solutions slows penetration of the wood.

Preferably, after removal of the treated bellies, backs, and sides from the varnish immersion bath, excess varnish is wiped from the wood, and the pieces are hung to dry for approximately one week. The backs, bellies, and sides are then incorporated into violins, and varnish is applied to the exterior of the violins. After applying a coat of varnish, the violin is allowed to dry for approximately one week before application of a second coat. This process is repeated until four to six coats of varnish are applied to the violin.

Please note that while the process of the present invention has been primarily designed for violins, its use should not be limited to violins only, but should be applicable to all violin type instruments which includes violins, violas, violoncellos, double bass, and other stringed wood instruments.

If no dye is added to the varnish, the resulting violin type instruments will have a yellowish color, similar to the color of some of the violins produced by Amati. In a preferred embodiment, a suitable dye may be added to the varnish bath, or to the varnish used to coat the violin type instruments after removal of the wood pieces from the varnish bath and incorporation of the pieces into instruments. A preferred dye is known as dragon's blood, *sanguis draconis,* which is a resinous exudate from rattan palm fruits, *Daemonorops propinquus,* found in India and Southeast Asia. Dragon's blood dissolves in alcohol, and is frequently used as a colorant for lacquers and varnishes. The color is largely due to the presence of dracoresene, $C_{26}H_{44}O_2$, and dracoalban, $C_{20}H_{40}O_4$, which give a golden or deep reddish tint to the varnish.

The invention will be better understood from a detailed description of other specific embodiments, using non-limiting examples, which relate to the treatment of wood to be used in violin type instruments with varnish under conditions of elevated temperature and pressure.

EXAMPLE 1

Spruce violin bellies and maple backs and sides were immersed into a varnish bath. Weights were used to hold the bellies and backs down with their concave sides facing upward. Glass marbles were added to the bath to conserve on the quantity of varnish used. It is envisioned that any other inert filler material could be used in place of the glass marbles. The varnish used was a dispersion of 30–35% tung oil in an organic solvent sold under the trade name of Formby's Tung Oil, manufactured by Thompson and Formby, Inc. of Olive Branch, Miss. However, as mentioned before, other drying oils, such as oiticica oil, modified castor oil, and other conjugated dienoic and trienoic acids may be used at greater or lesser concentrations. It is envisioned that varnish drying oil concentrations will be altered, and such alterations may require that the wood pieces have longer or shorter immersion time to achieve sufficient penetration of the wood.

The vessel containing the wood pieces immersed in the varnish bath should not be completely filled, so that, upon sealing and heating of the vessel, the varnish solution has room to expand. In a preferred embodiment, the lid of the vessel is fitted with a gasket to help ensure an air tight seal; the seal enables pressure to be applied above the varnish bath, and also helps to prevent evaporation of solvent and reduce oxidation of the drying oil.

The sealed vessel containing the varnish bath and wood pieces was then pressurized to approximately 5 psi above atmospheric pressure, and the varnish bath was heated by placing the vessel in partial shade on a warm sunny day. By partial shade, it is meant that direct sunlight should be avoided if the temperature and pressure in the varnish bath will exceed the preferred parameters. Note that direct sunlight may increase the pressure in sealed vessels containing the varnish bath to a point where an explosion may occur. The term partial shaded sunlight as used in defining the present invention indicates that the degree to which the varnish bath is exposed to sunlight will be determined by the intensity of the sun, the outside temperature, and the temperature and pressure desired for the varnish bath. Hence, the term partial shaded sunlight means that on a hot day, the varnish bath may be completely shaded from the sun, and, on a cold day, the varnish bath may be placed in direct sunlight. In a commercial endeavor, artificial means for increasing the temperature and pressure will probably have to be used such as would be apparent to those of skill in the art.

The temperature of the bath rose to 95° F. and the pressure increased to approximately 8 psi above atmospheric pressure during the hottest part of the day, and the temperature of the bath fell to approximately 75° F. and the pressure fell to approximately 2 to 3 psi above atmospheric pressure during the evening.

After 72 hours, the backs and sides were removed from the varnish bath, excess varnish was wiped off, and the backs and sides were hung to dry. The vessel was resealed, and the bellies left therein were subjected to the same conditions for an additional eleven days, e.g., temperatures ranging from 75° F. to 95° F. and pressures ranging from 2 to 8 psi above atmospheric pressure. The bellies were then removed from the varnish bath, excess varnish was wiped off of the bellies, and the bellies were allowed to dry for approximately one week.

The dried bellies, sides, and backs were then incorporated into violins, and 4 to 6 coats of the same varnish were applied to the exterior surface of the violins, with one week drying intervals allowed between coats of varnish. Care was taken so that the construction, dimensions, and material used in the violins closely duplicated the violins of Stradivari, Guaraneri, or Bergonzi. The resulting violins have a tone and power which approaches (and hopefully equals) the tone and power of violins produced by the great Cremonese craftsmen.

While a constant temperature and pressure may be used during immersion of the wood pieces, I have found that the daily rise and fall of the temperature and pressure caused by alternating sunshine and darkness speeds the penetration of the varnish into the wood. The rise and fall of the pressure and temperature may help force the exchange of entrapped air and liquids in the capillaries of the wood for varnish. Since the preferred drying oils are susceptible to oxidation in air, nitrogen gas can be introduced into the vessel above the bath to increase the pressure and reduce oxidation.

EXAMPLE 2

Violin bellies and backs were immersed in a solution of 0–35% tung oil in petroleum distillate. The temperature was held at 80° F. and the pressure was held at 40 psi above atmospheric pressure. After just 8 hours, there was noticeable warping of the wood and leaching. The warping and discoloring of the wood continued to increase after 24 hours and 48 hours.

EXAMPLE 3

The procedure of Example 2 was followed except the pressure was maintained at 20 psi above atmospheric pressure. Warping and leaching was noted after 8 hours, and continued to increase after 24 and 48 hour periods.

EXAMPLE 4

The procedure of Example 2 was followed except that the solution was maintained under a pressure of 10 psi above atmospheric pressure for 8 hours, 24 hours, and 48 hours. Leaching was noted at 8 hours, but no warping was noted even after 48 hours.

EXAMPLE 5

The procedure of Example 2 was followed, except that the pressure was maintained at 5 psi above atmospheric pressure. The immersed wood was examined after 8 hours, 24 hours, and 48 hours. After 48 hours some slight leaching was noted, but the wood did not warp.

The preceding examples demonstrate that the preferred conditions for immersion varnishing of violin wood involve pressures ranging from 2 to 5 psi above atmospheric pressure and temperatures ranging from 75° F. to 90° F. for periods of time ranging from 24 to 72 hours for maple wood backs and sides, and ranging from 1 to 14 days for spruce bellies.

From the above teachings, it is apparent that many modifications and variations of the present invention are possible. It is therefore to be understood that, within the scope of the appended claims, the invention may be practiced otherwise than as specifically described.

I claim:

1. A method for treating wood to be used in producing violin type instruments having improved tone, comprising the steps of:

(a) immersing wood pieces in varnish; and (b) subjecting said immersed pieces to elevated temperature and pressure for time periods ranging from 1 day to 14 days to enable said varnish to penetrate said immersed pieces.

2. Violins constructed using wood treated by the process of claim 1.

3. The process according to claim 1, wherein:

said varnish comprises a drying oil in a volatile solvent; and said wood comprises distinctly shaped pieces, said pieces comprising bellies, backs, and sides suitable for use in construction of violin type instruments.

4. The process according to claim 3, wherein:

said varnish further comprises a dye.

5. The process according to claim 4, wherein:

said dye is dragon's blood.

6. The process according to claim 3, wherein:

said drying oil is a glyceride.

7. The process according to claim 3, wherein:

said drying oil is a conjugated triolefinic oil.

8. The process according to claim 3, wherein:

said drying oil is selected from the group comprised of tung oil and oiticica oil.

9. Violins constructed using wood treated by the process of claim 8.

10. A process according to claim 1, wherein:

said elevated temperature and pressure are generated by sealing said pieces immersed in said varnish in a vessel, and alternately subjecting said vessel to partial shaded sunlight and darkness, said partial shaded sunlight varying in intensity so as to cause fluctuations in said temperature and said pressure in said vessel.

11. Violins constructed using wood treated by the process of claim 10.

12. The process according to claim 3, wherein:

said varnish comprises about 25 to 40% tung oil in a solvent;

said bellies are made from spruce;

said backs and said sides are made from maple;

said temperature ranges between about 70° F. and 95° F.; and said pressure ranges between about 1 and 10 psi above atmospheric pressure; wherein:

said bellites are treated for periods of time ranging from about 1 day to 14 days; and said backs and said sides are treated for periods of time ranging from about 1 day to 3 days.

13. A method of making violin type instruments comprising the steps of:

(a) immersing wood pieces in varnish;

(b) subjecting said immersed pieces to elevated temperature and pressure for time period ranging from 1 day to 14 days to enable said varnish to penetrate said immersed pieces; and (c) incorporating said pieces into violin type instruments in the conventional manner, whereby:

violin type instruments result that are capable of producing sound with improved tone when compared to violin type instruments that do not incorporate wood pieces treated by immersion in varnish under conditions of elevated temperature and pressure.

14. A method according to claim 13, further comprising the steps of:

(d) prior to performing step (c), drying said wood pieces;

(e) after step (c), applying varnish to the exterior surfaces of said violin type instruments; and (f) allowing said varnish applied to said exterior surfaces and said varnish that has penetrated said pieces to dry.

15. A method according to claim 13, wherein:

elevated temperature and pressure are generated by sealing said pieces immersed in said varnish in a vessel, and alternately subjecting said vessel to partial shaded sunlight and darkness, said partial shaded sunlight varying in intensity so as to cause fluctuations in said temperature and said pressure in said vessel.

16. A method according to claim 13, wherein:

said varnish comprises a drying oil in a volatile solvent; and said wood comprises distinctly shaped pieces, said pieces comprising bellies, backs, and sides suitable for use in construction of violin type instruments.

17. A method according to claim 16, wherein:

said drying oil is a glyceride.

18. A method according to claim 16, wherein:

said drying oil is a conjugated triolefinic oil.

19. A method according to claim 16, wherein:

said drying oil is selected from the group comprised of tung oil and oiticica oil.

20. A method according to claim 13, wherein:

said varnish comprises about 25 to 40% tung oil in a solvent;

said bellies are made from spruce;

said backs and said sides are made from maple;

said temperature ranges between about 70° F. and 95° F.; and said pressure ranges between about 1 and 10 psi above atmospheric pressure; wherein:

said bellies are treated for periods of time ranging from about 1 day to 14 days; and said backs and said sides are treated for periods of time ranging from about 1 day to 3 days.

* * * * *